US009979092B2

(12) United States Patent
Dobric

(10) Patent No.: US 9,979,092 B2
(45) Date of Patent: May 22, 2018

(54) PATCH ANTENNA ARRANGEMENT

(71) Applicant: KATHREIN-WERKE KG, Rosenheim (DE)

(72) Inventor: Nikola Dobric, München (DE)

(73) Assignee: Kathrein-Werke KG, Rosenheim (DE)

( * ) Notice: Subject to any disclaimer, the term of this patent is extended or adjusted under 35 U.S.C. 154(b) by 0 days. days.

(21) Appl. No.: 14/401,331

(22) PCT Filed: Apr. 18, 2013

(86) PCT No.: PCT/EP2013/001158
§ 371 (c)(1),
(2) Date: Nov. 14, 2014

(87) PCT Pub. No.: WO2013/170922
PCT Pub. Date: Nov. 21, 2013

(65) Prior Publication Data

US 2015/0123865 A1 May 7, 2015

(30) Foreign Application Priority Data

May 16, 2012 (DE) ..... 10 2012 009 846

(51) Int. Cl.
*H01Q 19/00* (2006.01)
*H01Q 9/04* (2006.01)

(52) U.S. Cl.
CPC ..... *H01Q 19/005* (2013.01); *H01Q 9/0414* (2013.01); *H01Q 9/0428* (2013.01)

(58) Field of Classification Search
CPC ... H01Q 9/0414; H01Q 9/0428; H01Q 19/005
See application file for complete search history.

(56) References Cited

U.S. PATENT DOCUMENTS 7,119,746 B2 * 10/2006 Luk ..... H01Q 9/36 343/700 MS
2002/0180649 A1 12/2002 Iguchi et al.
(Continued)

FOREIGN PATENT DOCUMENTS

DE 10 2004 035 064 2/2006
DE 10 2006 027 694 9/2007
(Continued)

OTHER PUBLICATIONS

English translation of the International Preliminary Report on Patentability and Written Opinion of the International Searching Authority dated Nov. 27, 2014, issued in corresponding International Application No. PCT/EP2013/001158.
(Continued)

*Primary Examiner* — Daniel J Munoz
(74) *Attorney, Agent, or Firm* — Nixon & Vanderhye P.C.

(57) ABSTRACT

The invention relates to an improved antenna arrangement which is characterized by the following features: a patch electrode (7) having a patch electrode surface (71) is provided above the dielectric (5) or on the upper face (5*a*) of the dielectric (5), said patch electrode (7) is fed via a feed line (11) that passes through the dielectric (5) and in doing so is led to a feed point (11*a*), which is galvanically or capacitively connected to the patch electrode (7). An electrically conductive top patch (23) having a top patch surface (23') is provided at a distance (D) above the patch electrode (7), said patch electrode (7) and the top patch (23) are arranged perpendicularly to a central axis (Z) passing through the antenna arrangement, said antenna arrangement being formed as a left or right circular polarized antenna arrangement. The at least one electric connecting line (29) between the patch electrode (7) and the top patch (23) has at least line
(Continued)

Figure 1:
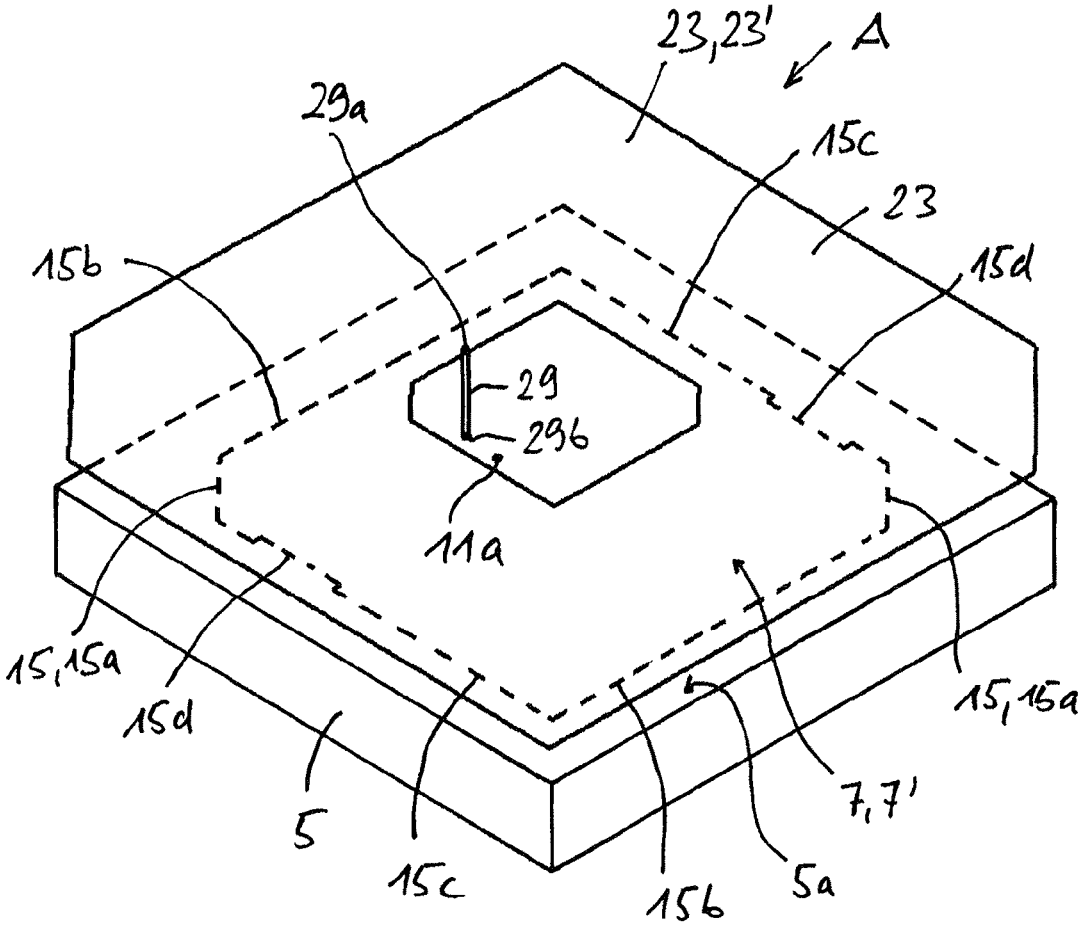

sections (29*d*) which are aligned transversely with respect to the central axis (Z).

25 Claims, 15 Drawing Sheets

(56) References Cited

U.S. PATENT DOCUMENTS

| | | | | |
|---|---|---|---|---|
| 2003/0164797 | A1 | 9/2003 | Ngai et al. | |
| 2005/0206568 | A1 | 9/2005 | Phillips et al. | |
| 2006/0001574 | A1* | 1/2006 | Petros | H01Q 9/0407 343/702 |
| 2006/0097924 | A1* | 5/2006 | Yegin | H01Q 9/0407 343/700 MS |
| 2008/0122697 | A1* | 5/2008 | Mierke | H01Q 9/0414 343/700 MS |
| 2009/0058731 | A1 | 3/2009 | Geary et al. | |
| 2010/0207841 | A1 | 8/2010 | Carr | |

FOREIGN PATENT DOCUMENTS

| | | |
|---|---|---|
| DE | 10 2006 038 528 | 11/2007 |
| DE | 10 2004 016 158 | 6/2010 |
| EP | 1 616 367 | 6/2004 |
| WO | WO 2009/093980 | 7/2009 |

OTHER PUBLICATIONS

International Search Report for PCT/EP2013/001158 dated Jun. 21, 2013.

S. Sevskiy et al., "Air-Filled Stacked-Patch Antenna", In: International ITG-Conference on Antennas, ITG-Conference on Antennas, ITGFachbericht 178, S. 53-56, Sep. 2003.

* cited by examiner

PATCH ANTENNA ARRANGEMENT

This application is the U.S. national phase of International Application No. PCT/EP2013/001158 filed 18 Apr. 2013 which designated the U.S. and claims priority to DE 10 2012 009 846.4 filed 16 May 2012, the entire contents of each of which are hereby incorporated by reference.

The invention relates to a patch antenna array according to the preamble of claim 1.

Patch antennae of the kind in question are also frequently used as motor vehicle antennae. Motor vehicle antennae can, for example, have a fin-like construction. They are frequently mounted on the bodywork and in particular in the roof region of a motor vehicle, just in front of the rear window. On a chassis underneath the cover of the antenna array there are normally a large number of individual antennae for the various intended services, i.e. antennae for receiving terrestrial radio programmes, GPS patch antennae, antennae for mobile communications for sending and receiving mobile phone calls in a host of different frequency ranges and, if applicable, further antenna arrays for receiving radio programmes broadcast via satellite such as SDARS programs, etc. Such an antenna has become known for example from EP 1 616 367 B1.

With regard to the basic construction of a patch antenna, reference is also made to DE 10 2004 016 158 B4 among others, which describes a conventional patch antenna with a ground plane, a substrate layer on top of it and a patch electrode provided on the upper side, which can be coated with another layer forming a dielectric.

A patch antenna has become known, for example, from DE 10 2006 038 528 B3. With such an antenna, an influence on the antenna diagram can be achieved in a simple manner.

This generic patch antenna comprises a dielectric with a ground plane on the underside of the dielectric and a radiation plane formed on the upper side of the dielectric.

Above the radiation plane and at a distance from it, a supporting device, likewise consisting of a dielectric, is arranged on which a further passive, electrically conductive patch element is provided.

A patch antenna array, which is comparable and similar in this respect, has also become known from DE 10 2006 027 694 B3. This patch antenna array also has a further electrically conductive patch element above the radiation plane of the patch antenna and at a distance from it, which is intended to improve the electrical properties of the antenna. The special feature of this pre-published patch antenna is that the supporting device, which supports the upper passive patch electrode, has a thickness and a height which are less than the thickness or height of the patch element itself.

Lastly, a specific construction of a patch antenna is known from a prior publication by the Institute of High Frequency Technology and Electronics at the University of Karlsruhe, entitled "Air-Filled Stacked Patch Antenna" (by Sergey Sevskiy and Werner Wiesbeck), with an underlying reflector with a ground plane arranged over it with the interposition of a dielectric and with an active patch surface provided above the ground plane (again with the interposition of a further dielectric), above which active patch surface an upper patch is arranged, once again with the interposition of two dielectric layers.

This antenna array is a linearly polarised antenna, the ground plane of which has two slots which are perpendicular to one another but do not intersect, which are required for feeding the active patch located above. Another special feature of this linearly polarised patch antenna array is that the base plate, the active patch surface located at a distance above it and the upper patch array located in turn above this are each connected to one another via a central spacer, which is electrically conductive. A short-circuit is thus achieved, namely between the ground plane, the actively radiating patch surface and the uppermost cover patch.

Lastly, an antenna module in the form of a patch antenna array has also become known from DE 10 2004 035 064 A1. This patch antenna array comprises a lower patch antenna and an upper patch antenna, with smaller dimensions, positioned above it with an upper dielectric substrate, an $\lambda/2$ antenna structure formed on the upper side of the upper substrate for frequencies in the GHz range for satellite reception, a metallisation being provided underneath the upper substrate.

As a result of this construction comprising a plurality of planes, an antenna is therefore proposed which among other things can also receive signals with circular polarisation at an elevation angle of below 30° to 90°, for example, to the horizontal. This advantage is, however, accompanied by considerably higher construction costs, which again proves to be disadvantageous.

A generic patch antenna array has become known from US 2003/0164797 A1. This prior publication covers a wide variety of patch antenna arrays.

In some embodiments, an upper patch array is provided between and offset from a ground plane and a patch surface arranged at a distance therefrom with the interposition of a dielectric. In this arrangement, feeding can occur in various ways. For example, one embodiment provides for the intermediate patch between the ground plane and the upper patch antenna array to be actively fed, this intermediate patch then being electrically connected via an additional connecting line to the upper patch element. In a different embodiment, the uppermost patch is actively fed, the interim patch antenna between the upper patch antenna array and the ground plate only being connected via a line connection from the upper patch.

In both embodiments, however, a galvanic line connection is also provided between the ground plane and the intermediate patch located between the ground plane and the upper patch antenna array. This electrical line connection is used as a tuning structure.

The object of the present invention is to produce a patch antenna array with a comparatively simple construction, which has favourable radiation properties and in the process allows for dual reception, namely for example dual reception of terrestrial signals and circular signals (which are broadcast via satellite, for example). It is intended to be possible within the scope of the invention to produce a linear resonance frequency such that it is in the range of circular resonance and in particular allows for pivoting of the main lobe direction that is particularly advantageous for motor vehicles. In an advantageous manner it is intended to also be possible within the scope of the invention to change the directionality and/or to allow for beamforming.

Within the scope of the circularly polarised patch antenna array according to the invention, it is, however, likewise possible to change the directionality in a simple manner, i.e. to adapt the directionality as required in particular to the vehicle or the vehicle construction site.

For example, such patch antennae are frequently mounted in connection with motor vehicle antennae on the end of the roof of the bodywork directly in front of the beginning of the rear window, i.e. in a region in which the roof is already inclined downwards at least slightly. This leads to a modified position of the main beam direction of the patch antenna, which can have disadvantages in particular during the reception of GPS signals or, for example, SDARS signals and Sirius/XM signals in the North American region.

It can be described as extremely surprising that an improved radiation characteristic becomes possible within the scope of the invention by comparatively simple means, in particular adapting to the specific car construction on which the antenna is to be used.

This is ultimately achieved by a multi-layered construction with an active patch electrode and an attachment patch, which can be referred to as a passive patch electrode, overlaying the patch electrode at a distance.

The solution according to the invention firstly assumes that the passive attachment patch comprises an electrically conductive connection, for example in the form of a line or through-connection between the active, fed patch electrode and the attachment patch. In this arrangement, one or more of these through-connections can be provided. At the same time, however, no galvanic or capacitive electrical connection exists between the actively fed patch electrode and the ground plane. This is because such a connection would eliminate the desired advantages.

Furthermore, however, a connection line provided between the active patch electrode and the attachment patch has a length that is greater than the distance between these two electrodes. This can, for example, be achieved in that the connection line between the patch electrode and the attachment patch comprises at least a line portion, which extends with a central axis passing through a component transverse to the whole antenna array, in order to contribute to an extension of the connection line. This can, however, also be made possible inter alia in that the respective connection points of the connection line firstly to the patch electrode and secondly to the attachment patch do not align in a plan view, i.e. are not arranged behind one another when looking parallel to the central axis but rather are arranged offset from one another, as a result of which the connection line is again extended.

It is, however, also possible for the two connection points of the connecting line to the patch electrode and to the attachment patch to be arranged in alignment with one another when looking parallel to the central axis. In this case, however, the connection line comprises a line portion, which is formed like a sideways U, for example, when viewed from the side, i.e. line portions which extend transverse to the direction of the central axis in order to create the extension of the line.

It is also possible in a modified embodiment for a plurality of such line connections or through-connections to be provided between the actively fed patch electrode and the attachment patch, as a result of which an additional linear resonance for the attachment patch is now generated. Due to said line connections between the patch electrode on the one hand and the attachment patch on the other, the linear resonance of the attachment patch can now be relocated towards the circular resonance of the patch electrode depending on the number and arrangement of these line connections or through-connections, such that beamforming is thus accomplished. In other words, the main beam direction can therefore be set at an incline relative to the patch electrode surface, in a deviation from a perpendicular alignment.

The director used within the scope of the invention, i.e. the attachment patch used, not only serves to concentrate the antenna lobes (i.e. to change the radiation diagram of the antenna and to change the directionality of the antenna) but in addition, also creates another resonance to receive terrestrial signals, for example for the DAB L band. The resonance created can, however, also be used to manipulate the directionality of the patch antenna, in that the linear resonance of the director (attachment patch) interferes with the circular resonance of the patch antenna. "Beamforming" is also spoken of in this respect.

The effect referred to above again creates the desired advantage that such an antenna array can be fixed to a bodywork portion of a motor vehicle that is inclined relative to the horizontal as mentioned, for example just or directly in front of a rear window. Despite this inclined fixing, the main beam direction of the antenna array can be set more or less vertically.

Instead of a plurality of individual through-connections, the attachment patch can, for example, also be located on a printed circuit board material, which is arranged on or glued to the patch electrode. In this arrangement, the upper attachment patch and the printed circuit board material can have a recess with accordingly larger dimensions, for example a circular or oval recess, within which the through-connection is provided or a correspondingly block- or bolt-shaped electrically conductive connection is formed.

In summary, it can therefore be found that the substantial difference from the prior art resides in the contact between the director, i.e. the attachment patch, and the actual patch electrode. Due to the line connecting the director (attachment patch) to the patch electrode, which line galvanically or capacitively connects the patch antenna to the director, a circular resonance of the patch antenna is produced on the one hand and on the other hand an additional resonance with terrestrial directionality, which can be used, for example, for DAB L digital radio services. The line galvanically or capacitively connecting the director to the active patch electrode can be produced not only as a connecting line aligned perpendicularly to the patch electrode surface or perpendicularly to the director surface or a contacting line, for example in the form of a through-connection, etc., but also and especially as a line whose galvanic or capacitive connection point on the attachment patch, i.e. on the director, on the one hand and on the active patch electrode on the other hand are located offset from one another in a plan view of the whole patch antenna array. In other words, this bow-shaped connecting line being used can, for example, be Z-shaped or similar in a side view, namely with a central line portion, for example, which extends parallel or at least almost parallel to the director surface or to the active patch electrode surface.

In a preferred embodiment, the director, i.e. the attachment patch, is formed from an electrically conductive metal sheet, which can also be provided with edge portions formed all round or in portions at the peripheral edge if appropriate, which edge portions can be aligned or rimmed in various different ways.

Figure 2:
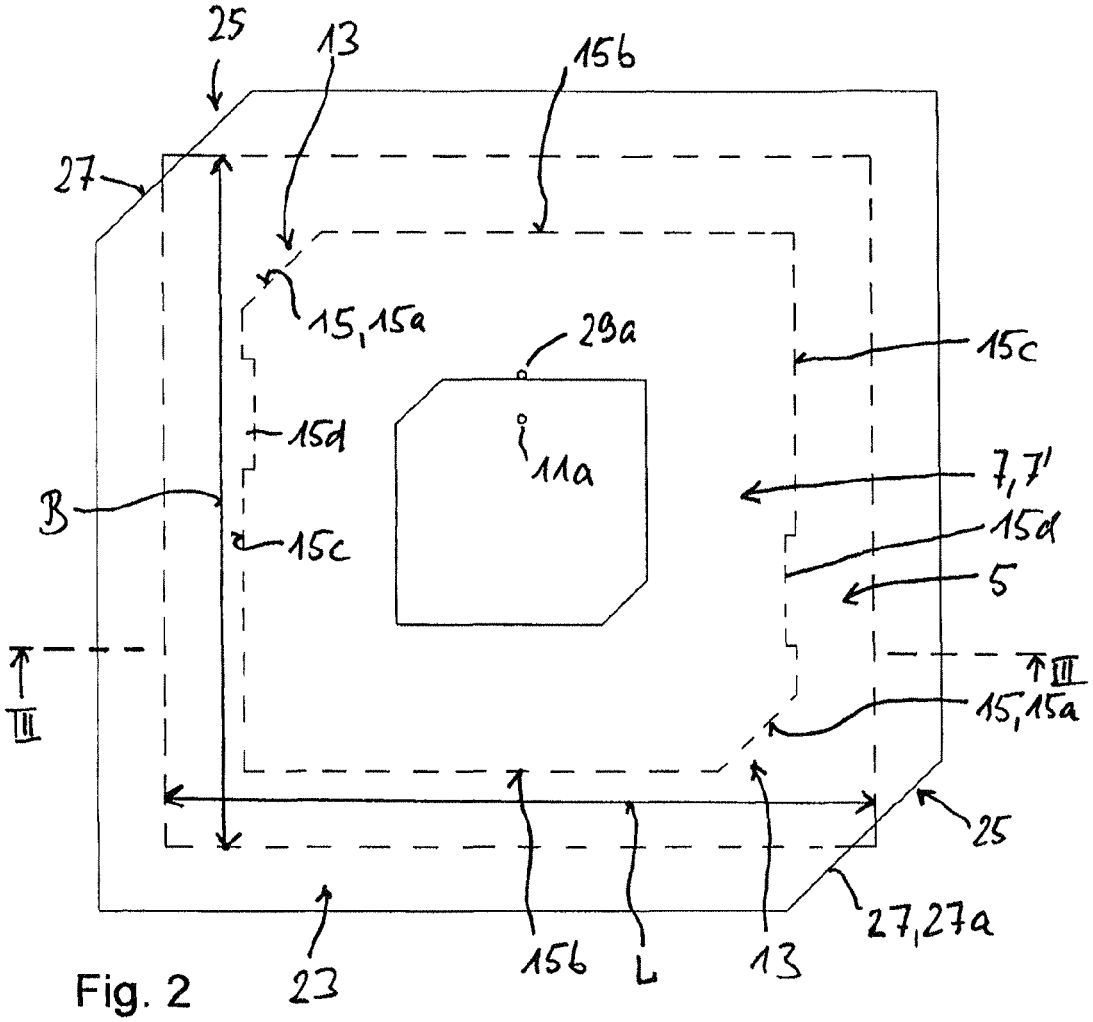
Figure 3:
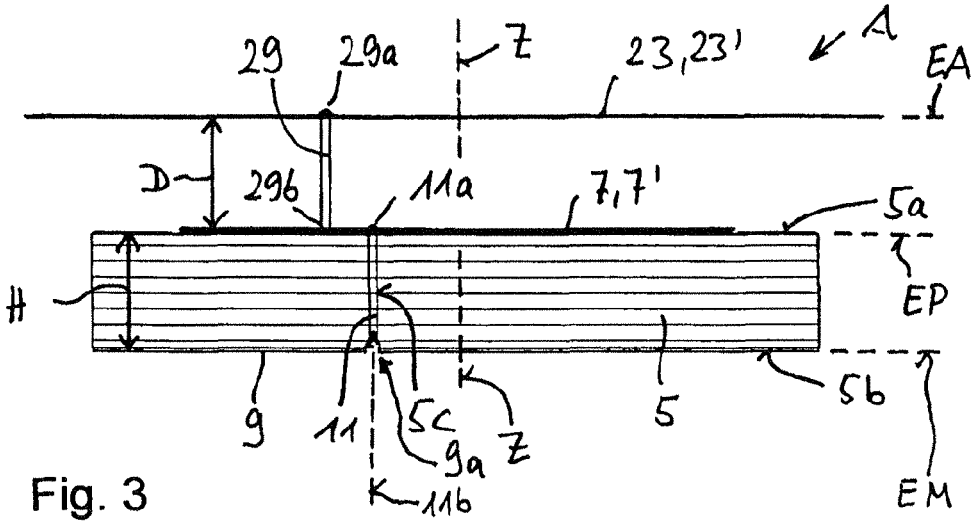
Figure 4:
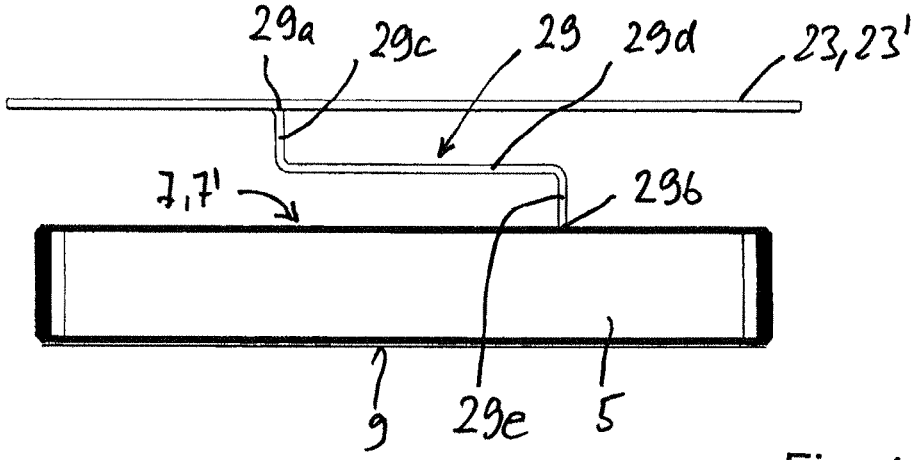
Figure 4A:
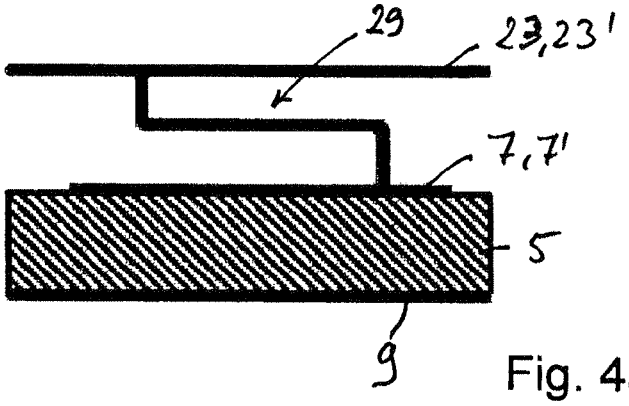
Figure 4B:
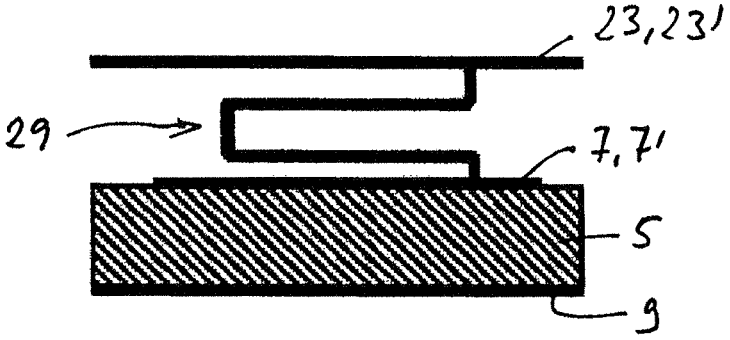

Further details, features and advantages of the invention will emerge from the embodiments shown in more detail in the drawings, in which:

FIG. 1: is a perspective view of a patch antenna to illustrate the basic principles of the embodiments according to the invention described hereinafter;

FIG. 2: is a plan view of the patch antenna shown in FIG. 1;

FIG. 3: is a cross-sectional view through the patch antenna shown, along the line III-III in FIG. 2;

FIG. 4: is a schematic side view of an embodiment according to the invention, which has been modified with respect to the example in FIG. 3;

FIG. 4*a*: is a schematic view of the embodiment according to FIG. 4 from the side;

FIG. 4*b*: is a modified view with respect to the representation according to FIG. 4*a;*

Figure 5:
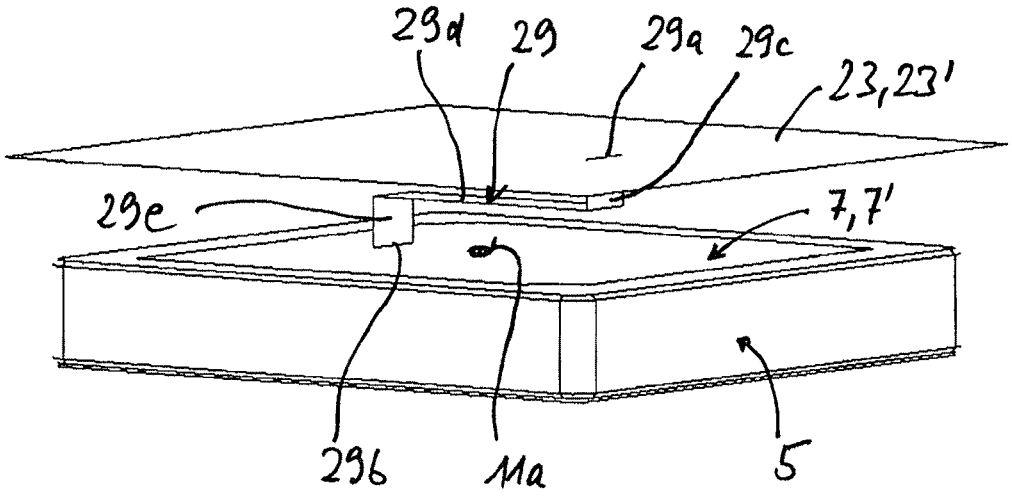
Figure 4C:
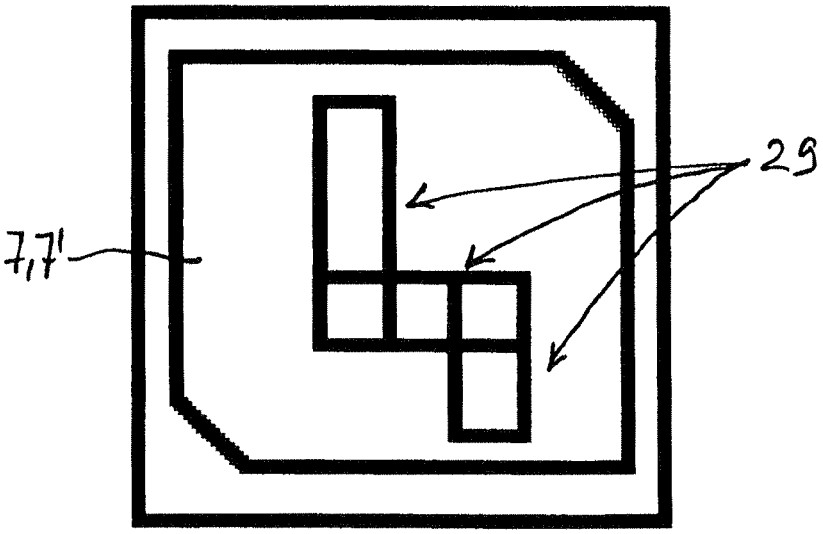
Figure 6:
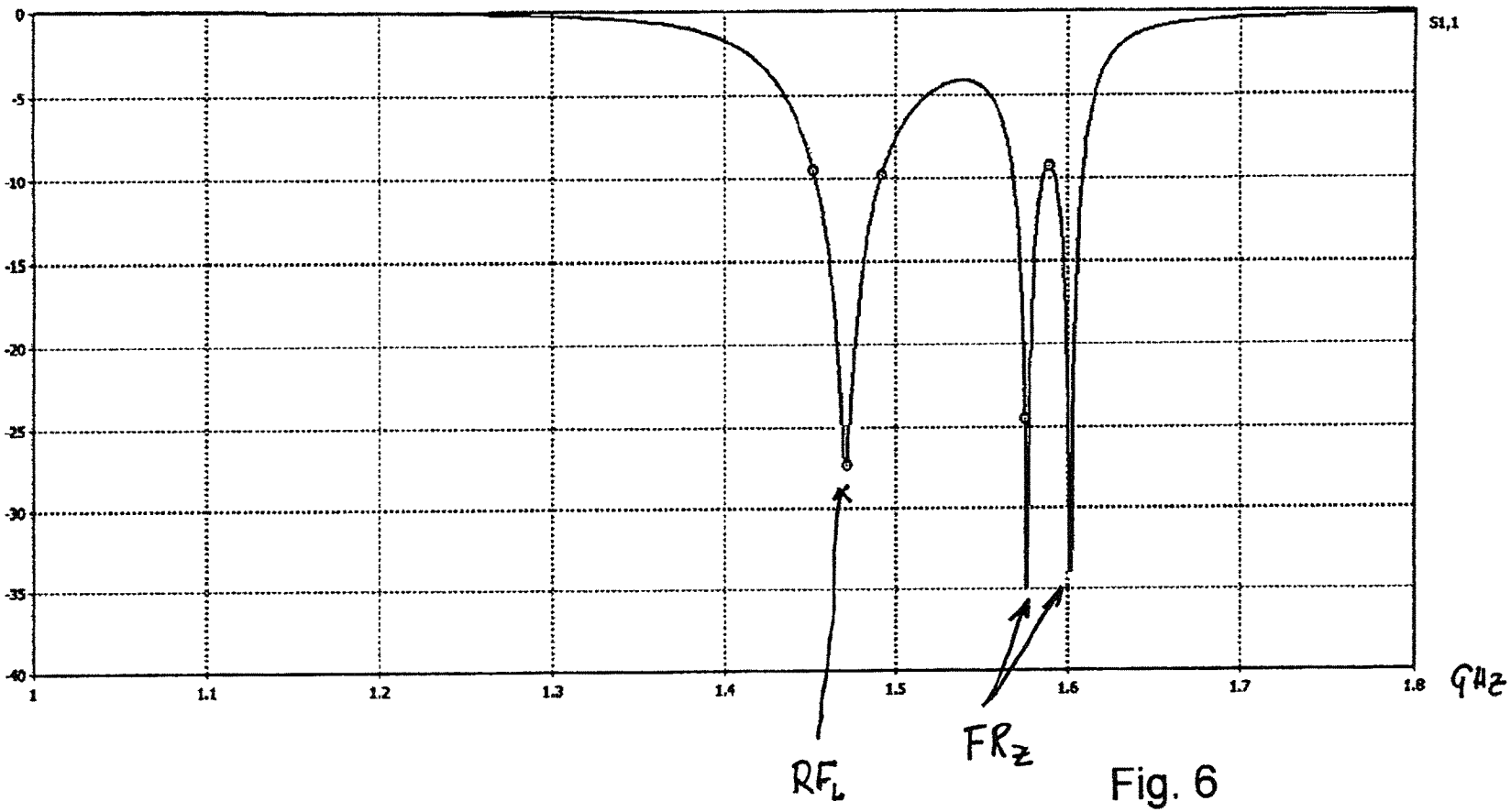
Figure 7:
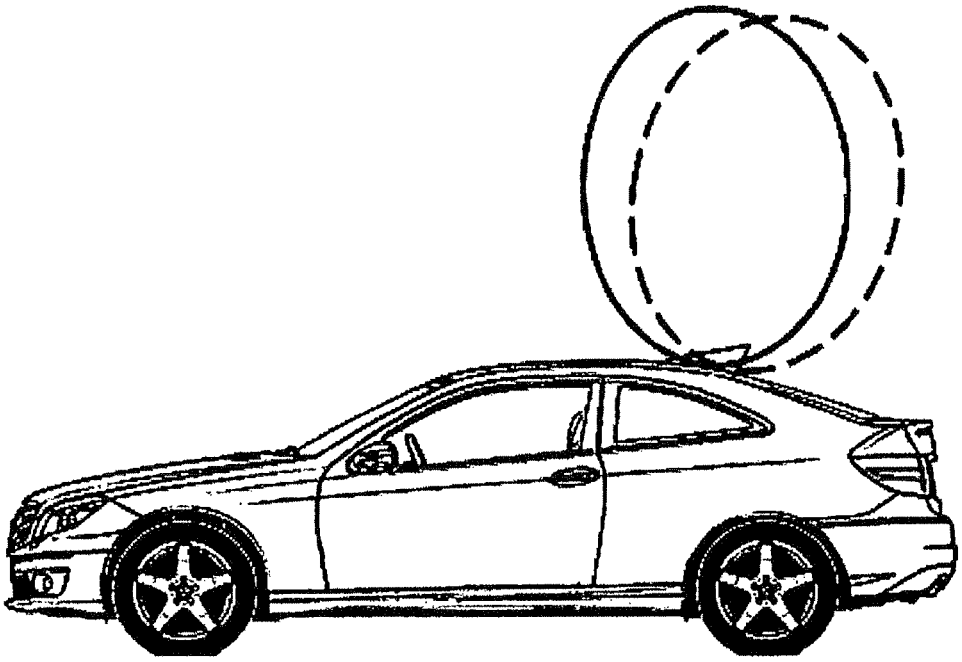
Figure 8:
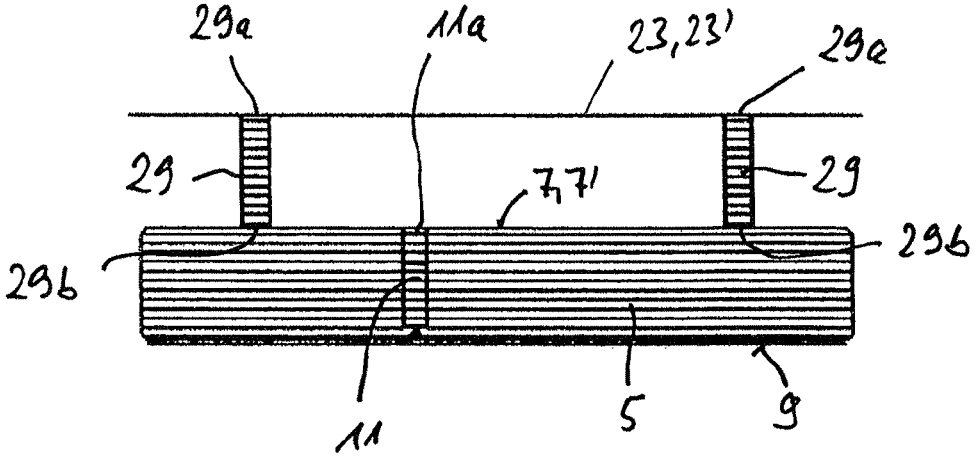
Figure 9:
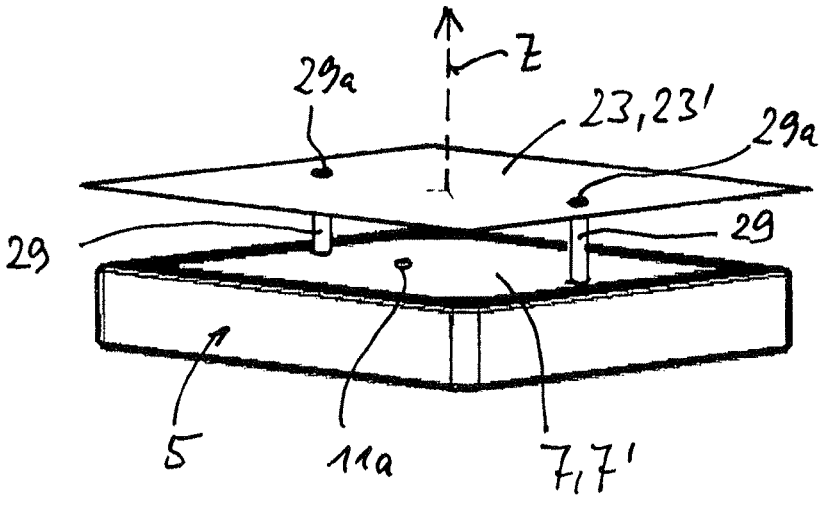
Figure 10:
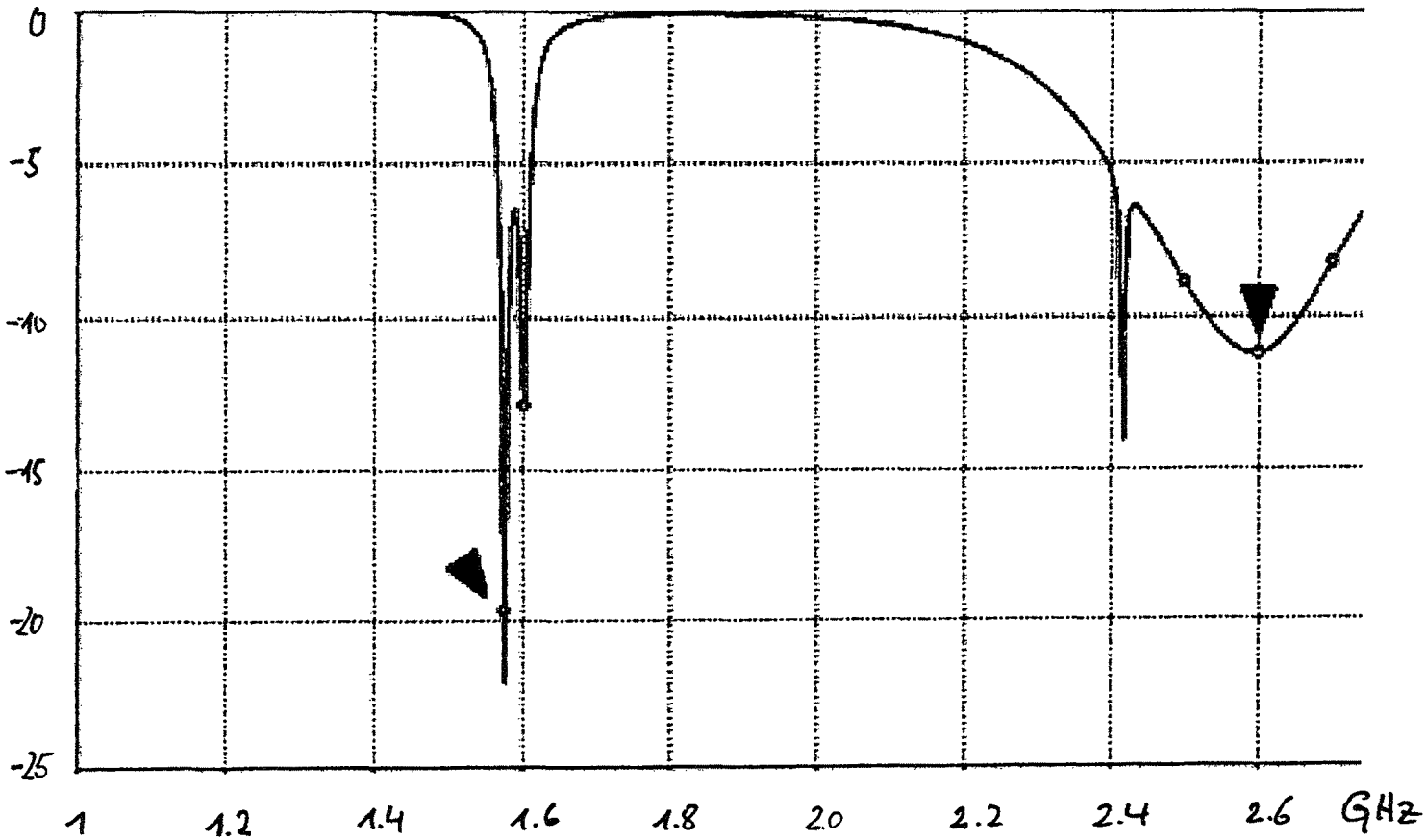
Figure 11:
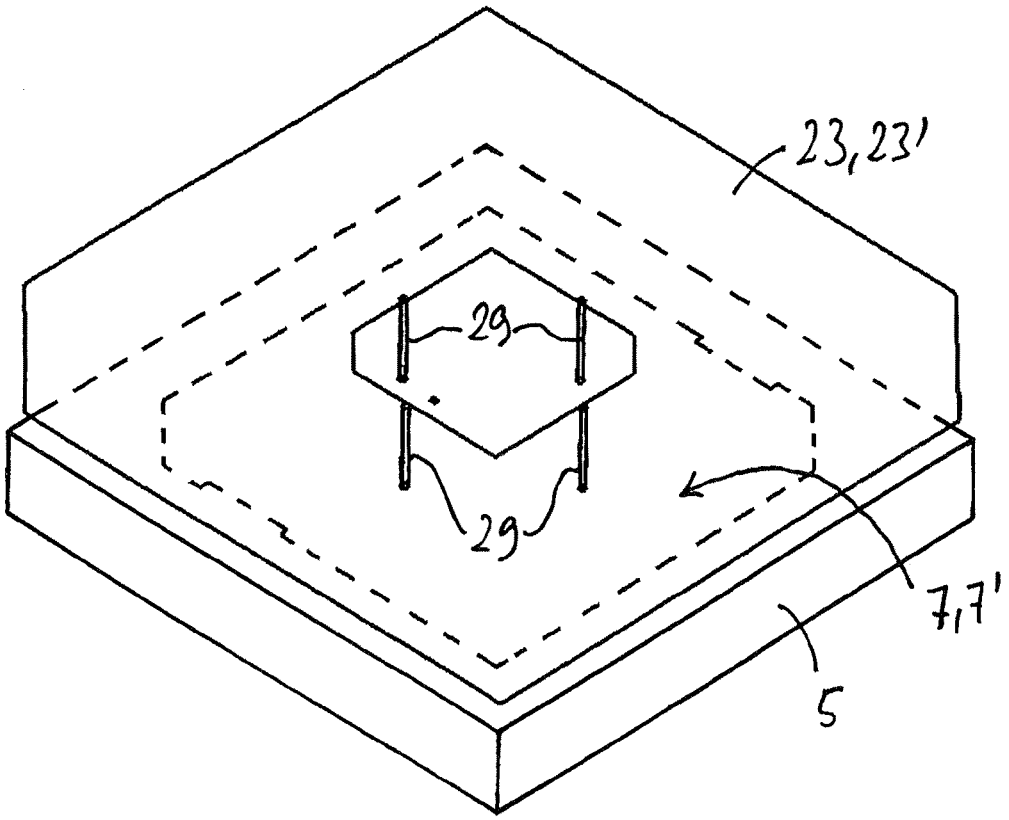
Figure 12:
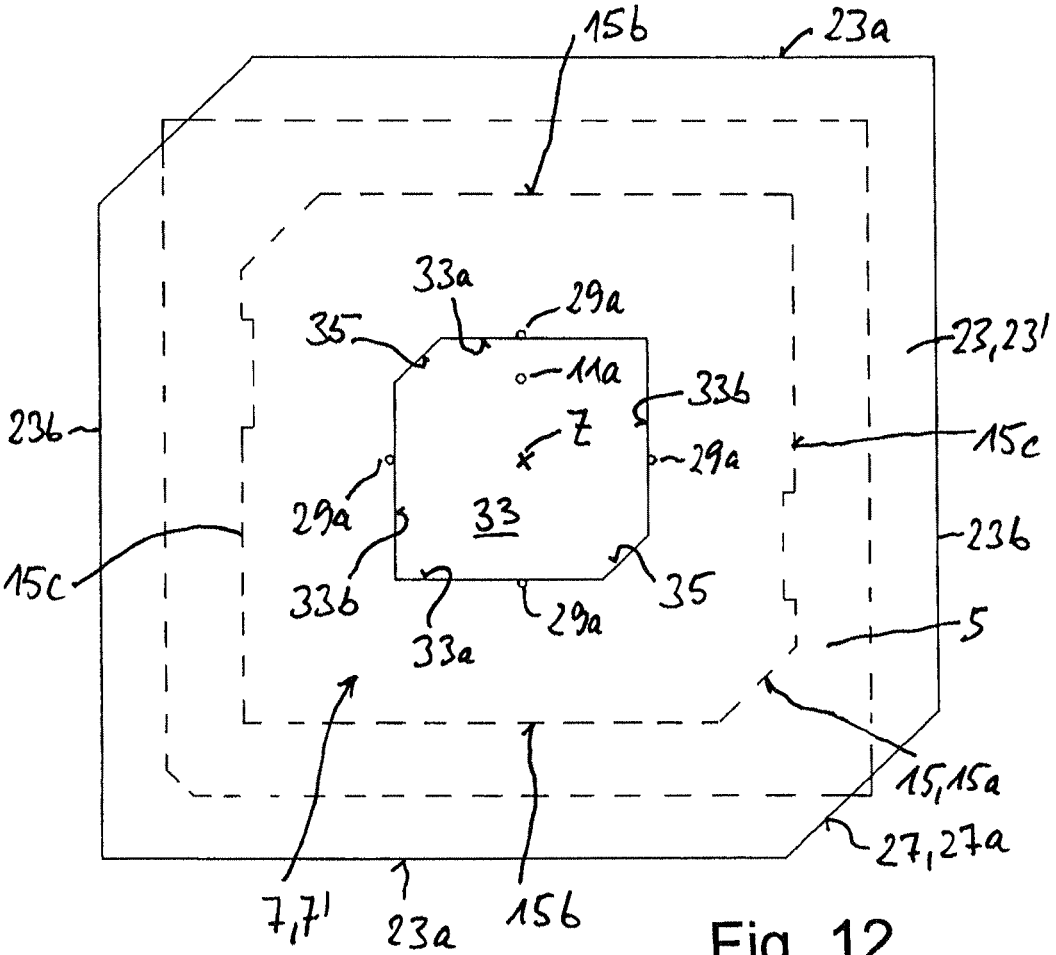
Figure 13:
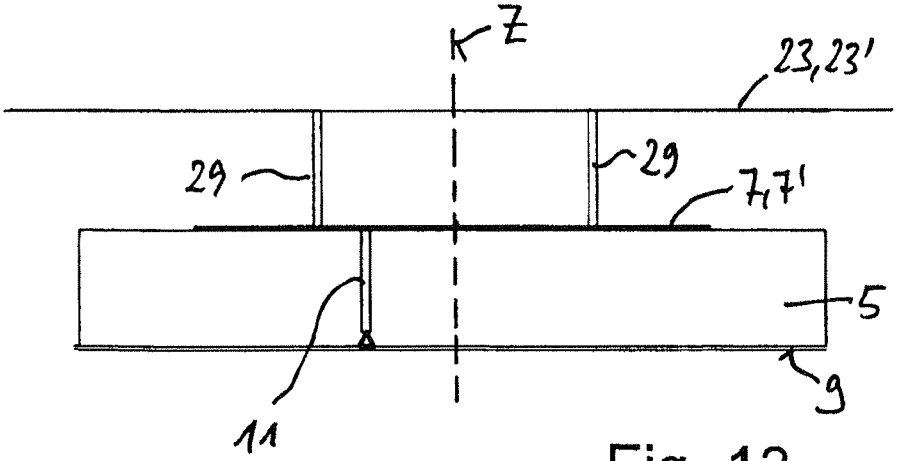
Figure 14:
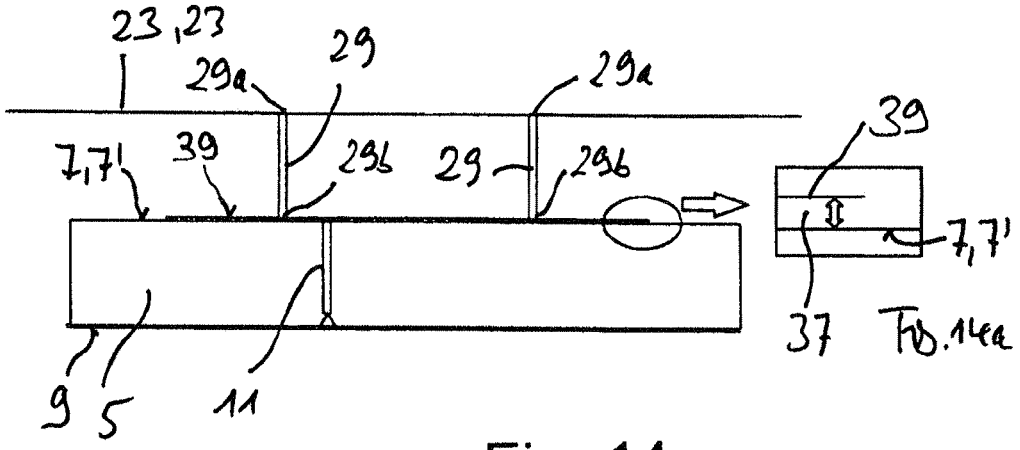
Figure 15:
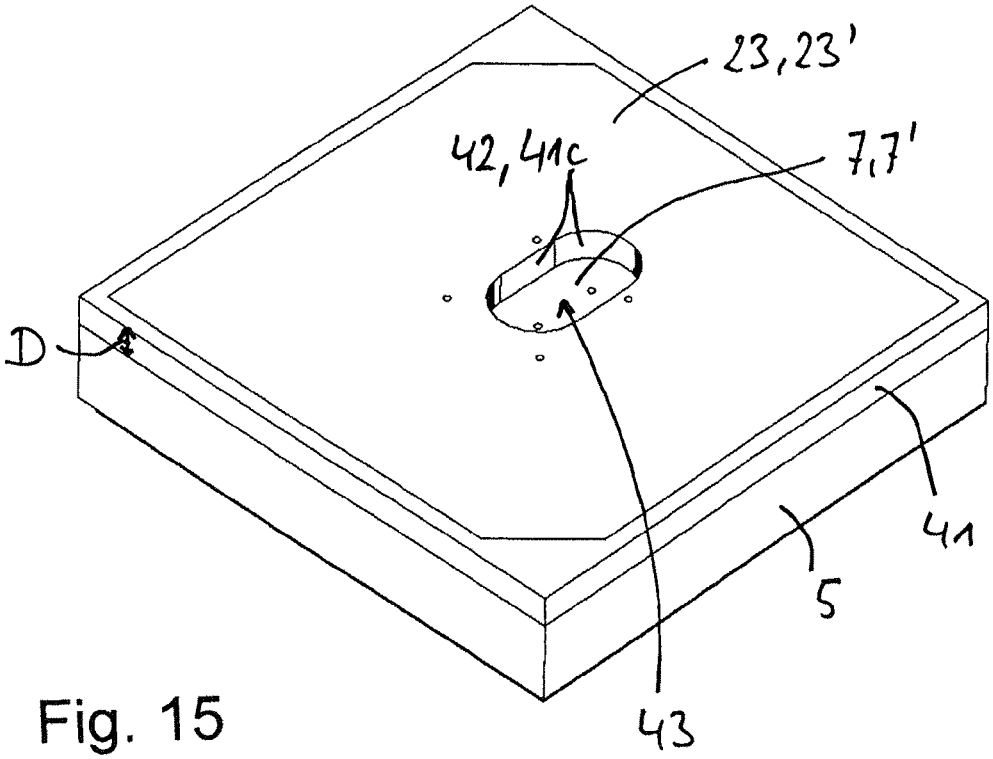
Figure 16:
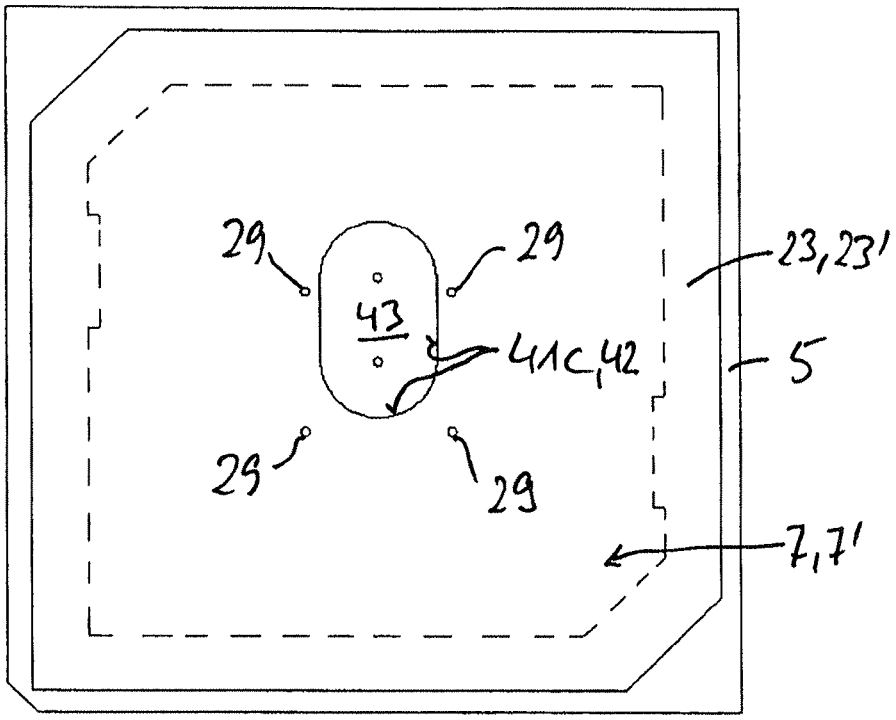
Figure 17:
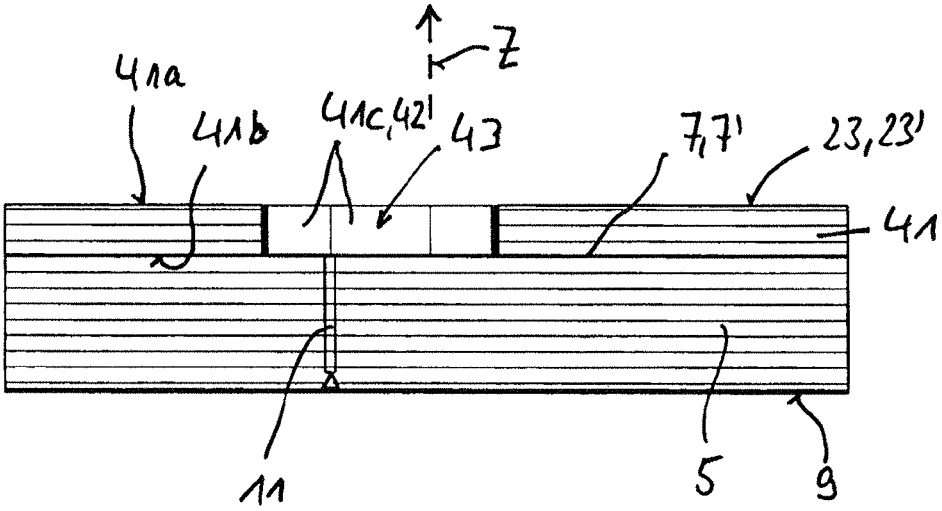
Figures 19A, 19B, 19C, 19D, 19E, 19F, 20A, 20B, 20C:
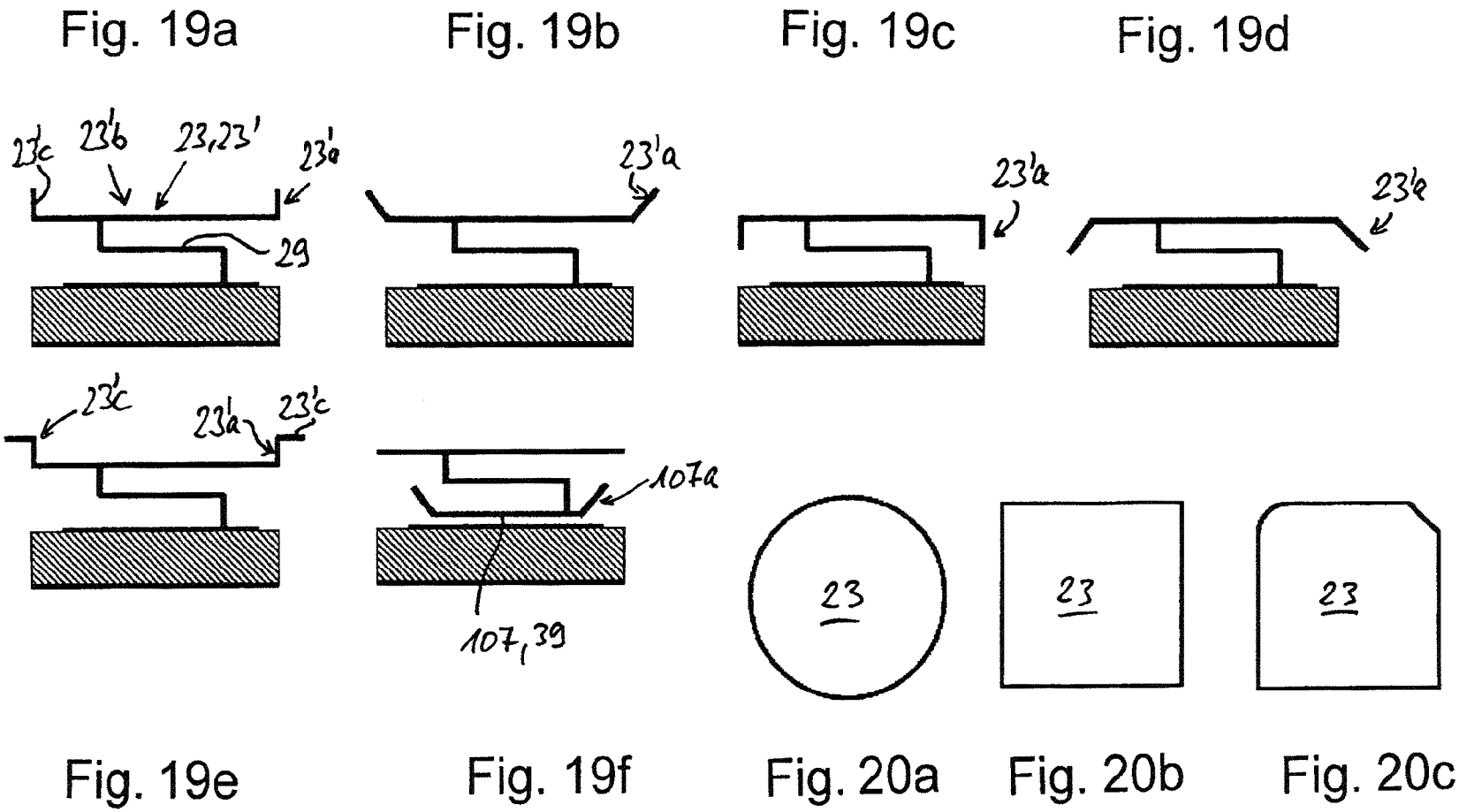
Figures 21, 22, 23:
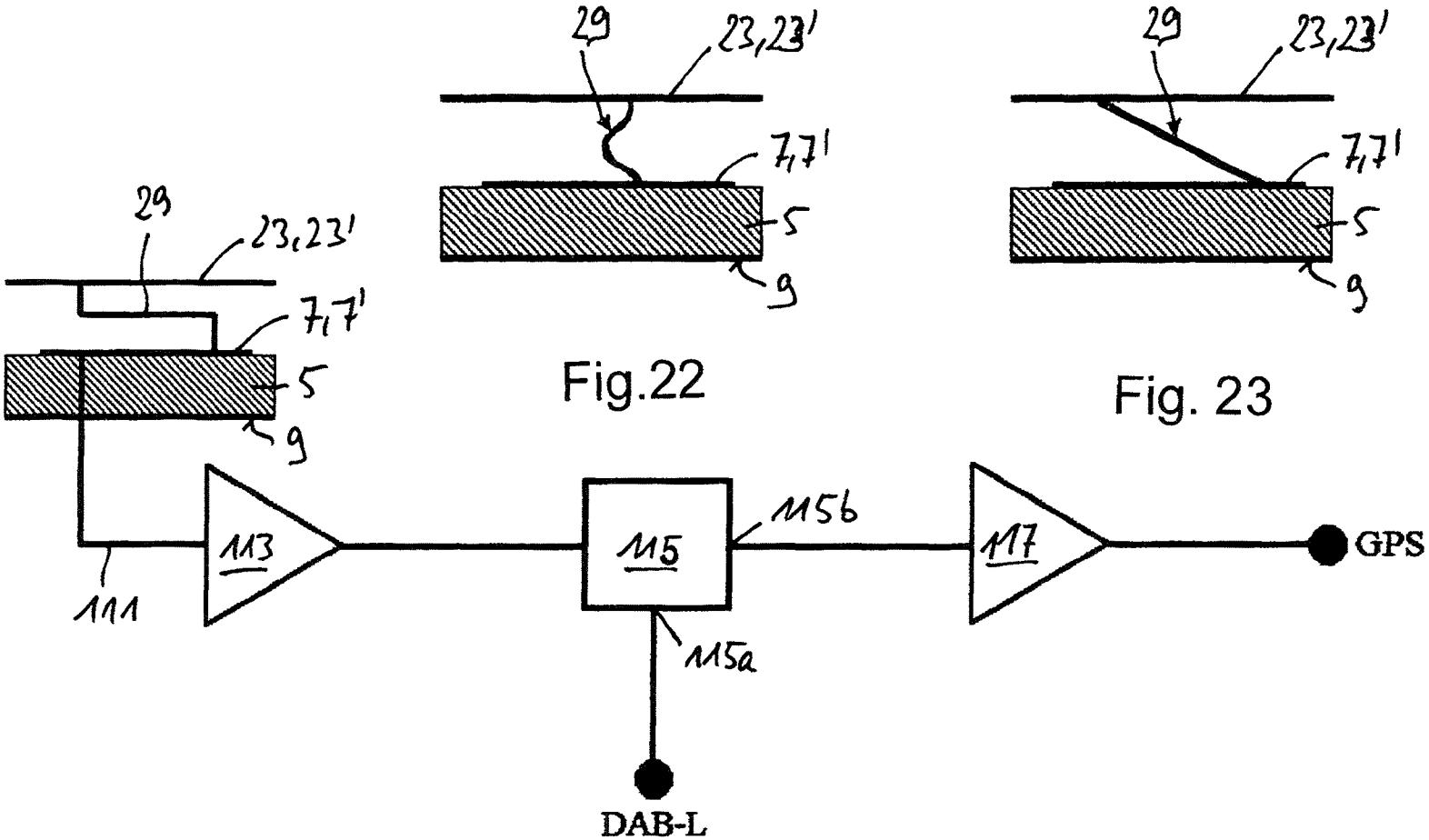

FIG. 4*c*: is a plan view of another modification with respect to the embodiments according to FIGS. 4*a* and 4*b* with a so-called three-dimensionally folded line connection, omitting the attachment patch;

FIG. 5: is a schematic three-dimensional view of the embodiment according to FIG. 4;

FIG. 6: is a resonance diagram relating to a patch antenna with a fed patch electrode and an attachment patch without the solution according to the invention;

FIG. 7: is a radiation diagram relating to a patch antenna array according to the invention mounted on a motor vehicle in the roof region just in front of the rear window, the directionality without the antenna array according to the invention being shown by a broken line and the directionality inclined towards it (now in a vertical direction) being shown by a solid line;

FIG. 8: is a schematic side view of a modified embodiment, which is not part of the invention, to illustrate that two connecting lines between the patch electrode and the attachment patch in principle also in the embodiments according to the invention;

FIG. 9: is a perspective view of the patch antenna according to FIG. 9;

FIG. 10: is a diagram to illustrate that when using the patch antenna array according to FIGS. 8 and 9, a resonance in the LTE region of 2.6 GHz, for example, can be produced;

FIG. 11: is cross-sectional view of an embodiment modified in relation to FIG. 1;

FIG. 12: is a plan view of the modified patch antenna according to FIG. 11;

FIG. 13: is a cross-sectional view through the patch antenna shown in FIGS. 11 and 12;

FIG. 14: is a cross-sectional view through a patch antenna modified in relation to FIG. 13;

FIG. 14*a*: is an enlarged detailed view from FIG. 14;

FIG. 15: is a perspective view of a further patch antenna;

FIG. 16: is a plan view of the patch antenna according to FIG. 15;

FIG. 17: is a cross-sectional view in a longitudinal direction through the patch antenna shown in FIG. 16, specifically through the longitudinal slot shown in FIG. 16;

FIG. 18*a*-FIG. 18*f*: are different schematic side or cross-sectional views through slightly modified embodiments according to the invention;

FIG. 19*a*-FIG. 19*f*: are further schematic views of further modified embodiments according to the invention;

FIG. 20*a*-FIG. 20*c*: is a schematic plan view to illustrate that the attachment patch, i.e. the director, can also have round or polygonal forms as well as a square shape, particularly when using an attachment patch in the form of a metal sheet;

FIG. 21: is an example of a circuit concept using the patch antenna array according to the invention, and FIG. 22-23: show schematic side views of two further modifications according to the invention.

Reference is made hereinafter to FIG. 1 to 3, in which firstly a basic construction of a patch antenna array is shown, on the basis of which the modifications described later are made.

It can be seen from these drawings that the either right or left circularly polarised patch antenna array comprises a substrate or dielectric 5, on the upper side 5*a* of which a metallised or metal surface is provided, by means of which an active patch surface 7 is formed, which is sometimes also referred to hereinafter as a fed patch surface 7 or patch electrode 7.

On the underside 5*b* of the substrate or dielectric 5 a ground plane 9 is provided as a counterweight.

A feeder 11 is provided through a hole 5*c* extending transversely and in particular perpendicularly to the upper side or underside 5*a*, 5*b* of the dielectric 5, the feeder normally being fed out from a region underneath the ground plane 9, via which the active patch electrode 7 is then fed via said feeder 11. For this purpose, the feeder 11 is connected to the patch electrode 7 at a feeding point 11*a*, namely galvanically or capacitively. The portion of the feeder 11 extending out from the lower ground plane 9 is identified by 11*b* and indicated by a broken line. For this purpose, a recess 9*a* is normally provided in the ground plane, via which the feeder 11 is fed through in a contactless manner.

It can also be seen from FIGS. 1, 2 and 3 that an uppermost attachment patch 23 is provided, which overlaps the actively fed patch electrode 7 that is located underneath it at a distance, both in the longitudinal and transverse directions, when viewed directly from above as in FIG. 2, similarly to the dielectric 5, which is also located underneath it and only protrudes outwards slightly on two opposite corner regions when viewing the patch antenna array from above. The remaining antenna array, which is overlapped in this respect by the attachment patch 23, with the dielectric 5 and the actively fed patch electrode 7 located on it, is therefore only drawn in with a broken line in FIG. 2. The attachment patch is described later in other respects. It can be seen from this array that the patch electrode 7 is formed so as to be at least almost rectangular or square in a plan view with two parallel longitudinal sides 15*b* and two transverse sides 15*c* extending perpendicularly to them and thus likewise parallel to one another, the patch electrode 7 being provided with a flat portion or chamfer 15 on two opposite corners, the patch electrode 7 here therefore being provided with an edge 15*a* extending perpendicular to the diagonals (of the patch electrode). Another recess 15*d* is also provided adjacent to the two opposite transverse sides 15*c*, i.e. a rectangular recess region 15*d* with a shallower depth. Using these measures, it is determined whether the patch antenna thus formed is right or left circular. If, for example, the patch antenna is intended to receive satellite signals according to the SDARS or Sirius/XM standard, the patch antenna would preferably be designed so as to be left circular. If it is to be suitable for receiving GPS data, that is to receive positional data, it would preferably be designed so as to be right circular.

It can also be seen from the view in particular according to FIG. 1 to 3, that above the patch antenna A thus formed, the aforesaid attachment patch 23, i.e. a so-called director 23, is provided, namely at a distance D.

The whole array is—as can be seen in particular in the plan view according to FIG. 2—such that the substrate or dielectric 5 is at least almost rectangular or square. It can be seen from FIG. 3, that the dielectric 5 has a height H (perpendicular to the upper side and underneath 5*a*, 5*b* of the dielectric 5). Moreover, the ground plane 9 overlays the whole underside 5*a* of the dielectric 5 in the embodiment shown. In principle, the ground plane 9 can, however, also be smaller, i.e. shorter in the longitudinal and/or transverse direction, or be constructed such that the dielectric 5 protrudes outwards in one or both directions of extension perpendicular to one another beyond the side boundary of the dielectric 5.

The patch electrode 7, which can also consist of a metal foil or metal sheet or a metallised layer, for example and which is provided on the upper side 5*a* of the dielectric 5, is shorter in the longitudinal and transverse direction in the embodiment shown than the longitudinal and transverse extension of the dielectric 5. The aforesaid patch electrode 7 with its patch electrode surface 7' can, however, equally be formed as a foil or a metal sheet, which is glued to the dielectric by inserting a layer of adhesive in between or a double-sided adhesive foil on the dielectric. Any desired modifications are possible in this respect.

It is apparent from the illustration that the patch electrode 7 lies in a plane EP and the attachment patch 23 in a plane EA arranged parallel to it at a distance D, whereas the ground plane on the underside 5*b* of the dielectric is arranged in a plane EM. All three planes are parallel, the overall construction being undertaken along a central axis direction or central axis Z which is perpendicular thereto. In this arrangement, the feeders and the at least one or the plurality of connecting lines 29 are normally aligned perpendicularly to said planes EM, EP and EA and thus parallel to the central axis Z.

The attachment patch 23, which overlays everything, with an attachment patch surface 23' likewise again consists of a metallised layer in the embodiment shown, preferably of a metal plate or sheet in the embodiment shown, i.e. of a good electrically conductive material. This attachment patch 23 is also designed in a plan view such that it is provided with a corresponding flat portion or chamfer 27 at two opposite corner regions 25, therefore again electrically conductive material is removed here along an edge 27*a* extending perpendicular to the diagonals (through the attachment patch 23).

In this arrangement, the flat portions or chamfers 27 thus formed are provided at precisely those corner regions or corners 25 at which the corresponding flat portions or chamfers 15 are formed on the feed patch 7 underneath.

In the embodiment shown according to FIG. 1 to 3, the attachment patch 23 is to be firmly fixed and held mechanically in a suitable manner, for example by separate spacers, etc., which consist of insulating material or generally of a dielectric.

In the embodiment shown, a line 29 is provided at a place between the patch electrode 7 and the attachment patch 23, i.e. a short circuit line 29, which in this embodiment is connected galvanically to the connection point 29*a* on the attachment patch 23 and also to the connection point 29*b* on the patch electrode 7; a short circuit connection is thus produced between the patch electrode 7 and the attachment patch 23.

As an alternative to the aforesaid galvanic connection between the director 23 and the patch electrode 7, a capacitive contact or connection between the director, i.e. the attachment patch 23, and the patch electrode 7 can also be provided.

The overall structure is therefore such that the patch electrode 7 is activated by means of said galvanic or capacitive feed via the feeder 11. The position of feed, i.e. the feeder 11 and in particular the feeding point 11*a*, in relation to the patch electrode but also to said flat portions or chamfers 15 on the patch electrode surface 7 ultimately determine the polarisation direction of the emitted or received electromagnetic field. In the present case, the patch electrode is preferably left circularly polarised, in order to be able to thereby receive Sirius/XM services, for example, broadcast via satellite, such as are on offer particularly in the North American region. In general within the scope of the embodiments described, the patch electrode 7 can be designed, formed and/or welded on depending on requirements within the scope of the overall structure of the patch antenna array such that the patch electrode can either be used as a left circularly polarised patch antenna or as a right circularly polarised patch antenna or patch electrode 7.

With reference to FIG. 4, a schematic vertical cross-sectional view of an embodiment according to the invention is now shown and in FIG. 5, a schematic perspective view of an improved embodiment of the patch antenna array described above is shown, in which said line connection 29 is Z-shaped, i.e. with a first line portion 29*c*, a central line portion 29*d* and a third or final line portion 29*e*, the first and third line portions 29*c* and 29*e* preferably being aligned transversely and above all perpendicularly to the respective surface 7' of the patch electrode 7 and transversely and in particular perpendicularly to the director surface 23', which are connected to one another via said central line portion 29*d*, which preferably extends parallel to the patch electrode surface 7' and to the director surface 23' (surface 23' of the attachment patch 23), which is likewise parallel to it. The first and second line portions 29*c*, 29*e* can, for example, have a length of 0.5 mm to 4 mm, in particular 1 mm to 3 mm, preferably 1.5 mm to 2.5 mm, in particular about 2 mm. The central line portion 29*d* creating the horizontal shift can, for example, be 5 mm to 15 mm, in particular 5 mm to 15 mm, in particular 6 mm to 15 mm, 7 mm to 13 mm, 8 mm to 12 mm and preferably 9 mm to 11 mm long, therefore in particular about 10 mm. The line can have a circular or oval cross section or, for example, a rectangular cross section, and therefore be designed in the style of a ribbon-like line connection, as is only schematically indicated in FIG. 5. The embodiment described applies to a distance D, for example, in the preferred order of 4 mm; it being possible for this distance to vary according to the sizes referred to above of the individual line connection portions.

Due to the line connection 29, which is provided additionally, for example in the style of a bow, between the patch electrode 7 and the attachment patch 23, a linearly polarised field is also created as can be seen in principle from the diagram according to FIG. 6, the two resonance frequencies $FR_z$ for the circularly polarised patch electrode 7 and the linear resonance $RF_L$ being drawn in and being created by the attachment patch 23, which is electrically connected to the patch electrode 7. The position and quantity of the line connection 29 ultimately determines the resonance frequency of the linearly polarised field thus created. In the process, the frequency in GHz is given in FIG. 6 on the X axis and the size of the S parameter in dB on the Y axis.

In order to explain the functionality, it is also noted that by means of said galvanic contact between the director 23 and the patch electrode 7 by said line connection 29, an additional resonance is created. Here, the contact (line connection 29) can consist of a bow as can be seen in FIGS. 4 and 5, and therefore be ribbon-like. The additional resonance created has a terrestrial directionality and can, for example, be used for receiving the DAB L band.

The variant according to FIG. 4 is shown again in a schematic, simplified side view as a sketch according to FIG. 4*a*, namely with the line connection 29, which is folded once in a side view and was also in part described as bow-shaped. This line connection can, however, as shown in FIG. 4*b* in a schematically reproduced modification, also be folded more than once, namely leading back and forth more than once. This folding is also described as two-dimensional. With reference to FIG. 4*c* it is indicated in a schematic plan view that the line connection 29 can also be three-dimensional, namely also with a line portion extending transversely such that the first and last line portions do not lie in a common plane.

Due to this different configuration, the line connection 29 can also have various lengths. It is noted in general that there is a correlation between the length of the line connection 29 and the frequency. The longer the line connection 29, the lower the frequency in relation to the linear resonance and vice versa.

In conclusion, it is also noted that the bow-shaped line connection 29 can have a large number of different configurations, can be strip-like or can have regions where it is thinner, etc. There is no restriction to certain forms and/or geometries in relation to the line connection in this respect. Due to the indicated so-called two-dimensional or three-dimensional configuration, the possibility arises of designing the line connection accordingly large and long even in the case of small installation spaces if required if a corresponding adaptation to the frequency is to be undertaken.

In order to now additionally allow for beamforming within the scope of the invention, in other words to cause a lobe to swivel in relation to the patch antenna, it is provided for the linear resonance, which is described in essence with reference to FIG. 6 and is offset from the circularly polarised resonance, to be shifted. As a result, the electromagnetic field of the circularly radiating resonance deforms. In order to shift the linear resonance into circular resonance, the position of the connecting line 29 is adapted according to its position since the position of the linear resonance depends on the position of the connecting line 29 and in particular on the feeder on the attachment patch 23.

The shift of the linear resonance $RF_L$ towards the circular resonance $RF_z$ is brought about by the position and quantity of line connections 29, for example in the form of the through-connections.

The desired result is shown with reference to FIG. 7, from which it can be seen that the main lobe direction, i.e. the main beam direction, can be inclined by 15°, for example, by using the patch antenna array according to the invention. FIG. 7 shows the directionality in an array without the beamforming according to the invention indicated by a broken line and the directionality with beamforming according to the invention is indicated by a solid line. In other words therefore, a beamforming process can be carried out within the scope of the invention by using the patch antenna array according to the invention such that as a result the directionality can be adapted to the vehicle bodywork. This offers advantages especially in the rear roof region of a motor vehicle, which is normally already slightly inclined downwards towards the rear window. Due to the beamforming according to the invention this inclination can be counteracted accordingly or the inclination of the roof can be compensated in this respect.

In order to illustrate the functionality of the adjustable directionality, it is noted that the patch electrode 7 can be activated by means of a galvanic or capacitive feeder 11. The position of the antenna feeder 11*a* (feeding point 11*a* on the patch electrode 7) and the phase at this antenna feeder 11*a* determine the polarisation of the radiated electromagnetic field. In the embodiment described, the patch electrode 7 is polarised left circularly (Sirius/XM service).

With the aid of the connecting line 29, for example in the form of contact legs, a linearly polarised field is created. The position and quantity of contacts or connecting lines determine the resonance frequency. The connecting lines, for example in the form of contact legs, can be connected capacitively or galvanically to the patch electrode. In order to bring about beamforming, i.e. a pivoting of the lobe, the linear resonance is shifted into the circular resonance. As a result, the electromagnetic field of the circularly radiated resonance deforms.

In order to shift the linear resonance into the circular resonance, not necessarily a plurality of, for example four, contacts or line connections 29 are required. A metallic cylinder or bolt or, for example, block, acting as a connecting line 29 has the same effect. What is decisive is that the line connection or contacts, irrespective of their nature, create a resonance, the frequency of which is as similar as possible to the circular resonance.

The shift of the linear resonance can—as already indicated—be brought about and adjusted even more optimally if the number of connecting lines, for example in the form of contacts or contact legs, is increased, as is shown in principle with reference to FIG. 8 to 10.

With reference to FIG. 8 to 10, a variant is shown in relation to the basic construction of two contacts, i.e. two connecting lines 29, which are offset by 180° to the central axis Z. Via these the director or attachment patch 23 is galvanically or capacitively connected to the patch electrode 7. Instead of the two connecting lines 29 shown in FIGS. 8 and 9 extending perpendicularly to the respective patch surface and thus parallel to the central axis Z, the Z-shaped connecting line shown in FIG. 4 could, for example, also be used, i.e. connecting lines, which are longer than the distance D between the patch electrode 7 and the attachment patch 23, in order to achieve the patch antenna array according to the invention. The director 23 is therefore located at a distance in the beam direction above the patch electrode in the variant shown in FIGS. 8 and 9. In this variant using two connecting lines 29, a resonance, for example in the LTE range of 2.6 GHz, is created, as can be seen from the diagram according to FIG. 10. The illustration of the X and Y axes here basically corresponds to the view according to FIG. 6.

In this embodiment, the two connecting lines 29 are arranged at 180° near two opposite longitudinal sides of the rectangular or square attachment patch 23 and patch electrode 7.

FIG. 11 to 13 show a similar embodiment, comparable to FIG. 1 to 3, but with the difference that in this embodiment four parallel connecting lines 29 are provided, which all extend perpendicularly to the alignment of the dielectric 5, i.e. perpendicularly to the upper side and underside 5*a*, 5*b* and thus perpendicularly to the surface EP of the patch electrode 7 and thus also perpendicularly to the surface EA of the attachment patch 23. This being the case, these examples are not part of the invention. However, if the aforesaid connecting lines 29 were to be replaced by other connecting lines 29 as explained with reference to the embodiments according to the invention, a patch antenna array according to the invention would be achieved. In the embodiment shown, four connecting lines 29 are used, which are each provided offset by 90° about the central axis Z, namely preferably approximately centred around the respective longitudinal or transverse side of the patch electrode 7.

Moreover, in the embodiment shown—as is also shown in the embodiment according to FIG. 1 to 3—the attachment patch 23 (director 23) is constructed such that it has a central opening 33, which is not absolutely necessary, however. In the embodiment selected, the shape of the central opening also emulates the attachment patch in plan view, and therefore has interior longitudinal and transverse edges 33*a*, 33*b*, which extend parallel to the longitudinal and transverse sides 15*b* and 15*c* of the external edges of the patch electrode 7 and parallel to the longitudinal or transverse sides 23*a*, 23*b* of the attachment patch 23.

Moreover, the central opening 33 has internal material portions or edges (chamfers) 35, which belong to the metallised surface of the attachment patch 23 and extend obliquely, such that the central opening 33 is similar in this respect in the path of its boundary edges to the path and configuration of the external edges 15*b*, 15*c* of the active patch electrode 7 including the two opposite oblique chamfers 15*a* and/or broadly similar to the path of the external edges 23*a*, 23*b* of the attachment patch 23 including the chamfers 27, 27*a* there, which are opposite each other at 180° and extend obliquely. This means that the corresponding edge portions are each parallel to one another and only differ from each other in terms of their length in principle. All oblique edges or chamfer portions 35 of the central opening 33 and the edges or chamfers 15, 15*a* of the patch electrode 7 and the chamfer or edge 27, 27*a* of the attachment patch 23 are all arranged in a plan view in the same alignment position, i.e. each parallel to one another.

In this arrangement, the aforesaid connecting lines 29 and their connecting points 29*a* are arranged directly on the peripheral longitudinal and transverse edges 33*a*, 33*b* of the central opening 33 or slightly outwardly offset therefrom.

Nevertheless, in order to shift said linear resonance shown in principle with reference to FIG. 6 into the circular resonance, it is not absolutely necessary for four connecting lines 29 to be used, in contrast to the first embodiment. It is equally possible to use fewer or more connecting lines as well, which are to be positioned at suitable points.

The stated dimensions of the patch antenna can vary within wide ranges.

For example, the dimensions of the substrate or dielectric 5 can be between 15 mm and 35 mm, in particular between 20 mm and 30 mm, in particular about 25 mm in the longitudinal and transverse direction.

The patch size in the longitudinal and transverse direction can, for example, be between 10 mm and 30 mm, in particular between 15 mm and 25 mm, in particular about 20 mm (for example about 19.6 mm). In general, the patch length in the longitudinal and transverse direction should be about 1 mm to 10 mm, preferably 3 mm to 8 mm, especially about 5 mm shorter than the longitudinal and transverse extension of the dielectric.

The attachment patch 23 can in turn have a length that is preferably 1 mm to 10 mm, preferably 3 mm to 8 mm, especially about 5 mm longer than the values given above for the longitudinal and transverse extension of the substrate or dielectric 5.

Furthermore, it has proven advantageous for the height, i.e. the distance D between the patch electrode 5 and the attachment patch 23, to correspond roughly to the thickness H of the dielectric 5. This value can preferably be between 2 mm to 6 mm, in particular 3 mm to 5 mm, preferably about 4 mm. Advantageous values for the dielectric $\Sigma_r$ are 8 to 11, in particular 8.5 to 10.5 or 9 to 10, preferably about 9.5.

With reference to the cross-sectional view according to FIG. 14 and the enlarged detailed view according to FIG. 14*a*, it is shown that the electrical connection between the attachment patch 23 and the patch electrode 7 can be not only galvanic but also capacitive.

For this purpose, it can be seen in the cross-sectional view according to FIGS. 14 and 14*a* that an electrically conductive coupling surface 39 is formed on the patch electrode 7, for example by using an insulating double-sided adhesive film 37 coupled capacitively to the patch electrode 7, and extends parallel to the patch electrode 7, the line 29 then being connected capacitively to this coupling surface 39 at the connection point 29*b* and to the attachment patch 23 at the connection point 29*a*.

In addition or alternatively, such a comparable coupling surface could also be formed on the underside of the attachment patch 23, galvanically separated from it, such that as an alternative to the variant according to FIG. 11, a capacitive coupling in the upper region of the attachment patch 23 is achieved as an alternative or in addition to the embodiment according to FIG. 11.

In this case too, not just one but rather a plurality of connecting lines 29 can be provided between the coupling surface 39 and the attachment patch 23, in order to shift the linear resonance into the circular resonance as required and thus to change the main lobe direction accordingly.

The capacitive coupling explained has been explained with reference to the example according to FIGS. 14 and 14*a*, which is not part of the invention, in order to illustrate that a corresponding capacitive connection can also be undertaken in the same manner in embodiments according to the invention.

Due to the beamforming brought about as a result of this, the main lobe positional modification can therefore be achieved e.g. an inclination of the main beam direction of roughly up to or more than 11° in relation to the vertical.

A further example according to FIG. 15 to 17 that is not part of the invention is also referred to hereinafter, the same reference numerals again relating to the same or comparable components.

In this case, the attachment patch 23 is not arranged over a dielectric consisting of air at a distance D from the substrate-electrode surface 7' (or on the coupling surface 39 located thereon), but rather a substrate or dielectric 41 is used here that is different from air, in the form of a printed circuit board material in the embodiment shown, for example a substrate 41 consisting of 2FR4.

In contrast to the distance D, for example in the embodiment according to FIG. 3, the distance D between the patch electrode 7, 7' and the upper side 5*a* of the dielectric and the underside of the attachment patch 23, 23' can be smaller in this variant explained with reference to FIG. 15, for example it can vary between 1 mm and 2 mm, and in particular be about 1.5 mm.

In order to show that not just one or more connection lines 29 have to extend between the patch electrode 7 and the coupling surface 39, which is capacitively coupled thereto, and the attachment patch 27, it is also shown with reference to FIG. 15 to 17 that here, for example, a metallised slot 43 can be provided, which passes through the substrate 41 with the attachment patch 23 located on top of it.

This slot 43, and therefore this recess 43 in general, which passes through the substrate 41 from its upper side and underside 41*a*, 41*b*, preferably perpendicularly to the surfaces EM, EP and EA and thus parallel to the central axis Z, has two parallel longitudinal sides in the embodiment shown and two semi-cylindrical opposite front faces, which are all denoted by the reference numeral 41*c*. The special feature in this embodiment, is that the interior or vertical surfaces 41*c*, which are sometimes also referred to hereinafter as end faces 41*c*, are coated with an electrically conductive layer, as a result of which a galvanic connection line 29 in the manner of a through-connection is formed from the patch electrode 7 located underneath it, or the coupling surface 39 that is coupled thereto, to the attachment patch 23 or a coupling surface capacitively coupled to the attachment patch and located underneath it.

Instead of the connection line 29 thus formed in the form of the through-connection 42, a corresponding metal cylinder or block, or a cylinder or block with at least one metallised surface, can also be used here, which has the same effect as already indicated.

In contrast to the embodiment shown, an electrical connection or connecting line 29 could also be achieved using a metal cylinder or, for example, metal block, which is arranged in the region of the recess or opening 43 shown in the drawings, instead of the metallised surfaces or sides 41*c* or of the through-connection 42 in general. An electrical/galvanic connection from the attachment patch 23 to the active patch electrode 7 can thus be achieved via this metal and therefore electrically conductive cylinder or block or similar. Likewise, a coupling surface could also be provided in this embodiment parallel to the patch electrode 7 and/or parallel to the attachment patch 23, such that the electrically conductive cylinder or block or similar is galvanically connected to the coupling surface concerned.

With reference to the view according to FIG. 16, the corresponding array is shown in a plan view, the through-connection 42 with the conductive surfaces 41*c* provided inside the slot 43 being drawn in and likewise the through-connections in the form of the connecting lines 29, which are normally provided as an alternative or in addition and which are offset outwards in relation to the central opening 33 or the slot 43.

This drawing also shows that the slot is not totally central in relation to the centre of the thus formed patch antenna, but rather is arranged so as to be slightly shifted in the longitudinal direction of the slot towards a lateral edge of the patch electrode.

The views according to FIG. 15 to 17 also show that the upper feeding point 11*a* of the feeder 11 is located and ends in the region of the recess, i.e. the central opening 43. Two feeding points 11*a* are indicated in this recess. One feeder, however—as described—is sufficient and can be arranged such that the feeder concerned either ends on one or other feeding point 11*a*. The other point shown in FIG. 15 therefore relates to an optional second feeder.

The patch antenna arrays described with reference to FIG. 15 to 17 can, however, also have a through-connection 42 and/or a cylinder or block provided in the corresponding recess and acting as a line connection between the patch electrode and the attachment patch. This through-connection 42 or the aforesaid cylinder or block can, however, extend obliquely in relation to the central axis Z and therefore extend, for example, away from the central axis Z, i.e. be provided obliquely such that the connection points 29*a* and 29*b* do not align with one another on the attachment patch or the patch electrode as described within the scope of the embodiments according to the invention.

Reference is also made hereinafter to schematic cross-sectional views of various embodiments of the patch antenna array according to the invention.

In the embodiments according to FIG. 18*a* to 18*f*, possible modifications are illustrated, which relate, for example, to the form, positioning and quantity of the contacts, i.e. the connecting lines 29, which have an influence on the position of the linear resonance in terms of frequency. The introduction of a dielectric between the director 23 and the patch electrode 7 changes the position of the resonance.

In the case of the variant according to FIG. 18*a*, the embodiment is reproduced schematically, which was described with reference to FIGS. 4 and 5, where the connecting line 29 is galvanically connected to both the director 23 and the patch electrode 7.

Figures 18A, 18B, 18C, 18D, 18E, 18F:
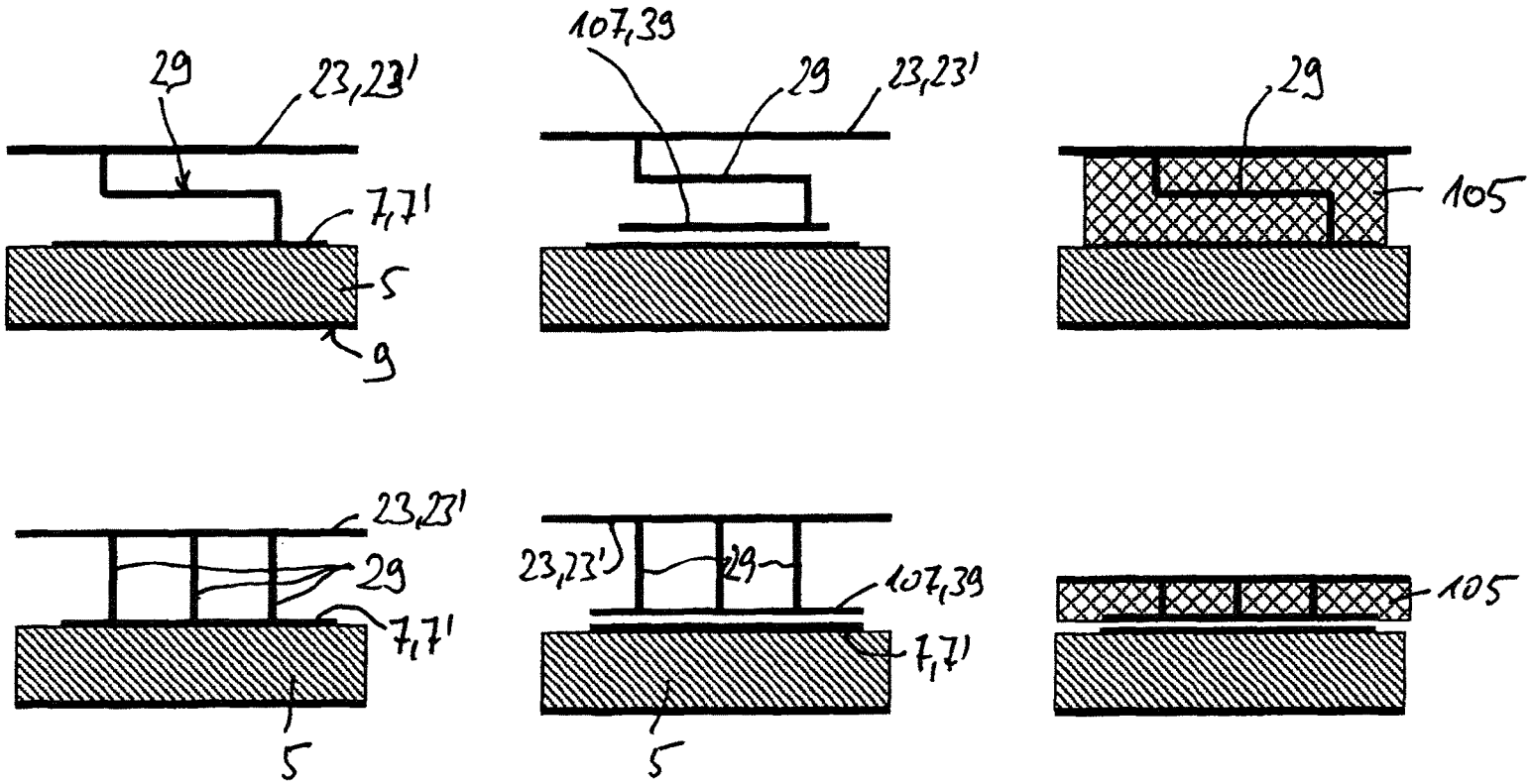

In the case of the variant according to FIG. 18*b*, this contact in the form of the contact line 29 has been carried out in a capacitive manner, namely by the insertion of an electrical coupling surface 107, 39, which is arranged at a short distance from the patch electrode 7 and therefore from the patch electrode surface 7', as a result of which a capacitive coupling arises. In addition to this or alternatively, a corresponding electrical coupling surface can be arranged parallel and underneath the director surface 23' such that the feeding point 11*a* is provided here on the additional coupling surface 107, at a small distance from the director surface 23'.

In the case of the variant according to FIG. 18*c*, the clearance in between the patch electrode 7 and the attachment patch 23 (director 23) is filled with a dielectric. The filled region with the dielectric 105 can be provided in the whole clearance or only in portions, for example in those portions in which the connecting line 29 is not constructed. FIG. 18*d* is only intended to show schematically that a plurality of contacts or connecting lines 29 can also be provided between the patch electrode 7 and the attachment patch 23, as has already been shown with reference to the embodiments according to FIG. 11 to 13.

In the case of the variant according to FIG. 18*e*, it is shown similarly to the modification according to FIG. 18*b* in contrast to 18*a* that in the case of a plurality of contacts or connecting lines 29, a capacitive coupling instead of a galvanic connection (as shown in FIG. 16*d*) can also be provided. Here too a capacitive coupling surface 107, 39 can be provided in the region of the patch electrode and/or also in the region of the director/attachment patch 23.

When a plurality of connecting lines 29 are being used, the clearance between the patch electrode 7 or, for example, the additionally provided capacitive coupling surface 107 on the one hand and the director surface 23 on the other can also be filled with a dielectric 105, as is shown, for example, with reference to FIG. 18*f*. As a result of this the height D of the clearance can also be reduced.

With reference to FIG. 19*a* to 19*f*, various variants are likewise shown, in particular for applications where it is not intended for the attachment patch, i.e. the director 23, to consist of a metallised surface in general but of a metal sheet, i.e. in particular of a metal sheet with no edges.

In the case of these embodiments, the director 23 and thus the director surface 23' have a peripheral, angled edge 23'*c*, i.e. with a single angle or a plurality of angles, in particular on the peripheral edge 23' of the central portion 23'*b* of the director 23, which can be provided so as to be a closed periphery or in sub-portions in the peripheral direction. These edge portions 23'*c* can be aligned in the beam direction, perpendicularly or inclined preferably away from the substrate 5, or towards the substrate 5. This is shown with reference to the various variants according to FIG. 19*b* to 19*d*. In the case of the variant according to FIG. 19*e*, the edge 23'*a* formed on the attachment patch 23 is designed as a stepped or angled edge with preferably parallel edge regions 23'*c* pointing outwards.

In the case of a capacitive connection, such as in FIG. 19*f*, for example, the additionally provided coupling surface 107, 39, which brings about a capacitive coupling, can also have an angled edge portion 107*a* all round or only in portions.

With reference to FIG. 20*a* to 20*c* it is only indicated that apart from the optional sheet forming—as described above—for the attachment patch 23, 23', round or polygonal forms are also possible as well as square sheet forms, likewise mixed forms with straight and rounded, oblique boundary edges.

Furthermore, a circuit concept is shown with reference to FIG. 21 using the circularly polarised patch antenna array according to the invention, an amplifier 113 being connected to a connecting line 111, which is connected to the patch electrode 7 (preferably galvanically connected, but also possibly capacitively connected), the amplifier being connected in series with an entry to a diplexer 115 to separate the GPS signal, for example, from the DAB L signal. In other words, the DAB L signal is at one output 115*a* of the diplexer 115, for example, and the GPS is at the other output 115*b* and can, for example, be fed into a second amplifier stage 117.

In other words, a common first amplifier stage 113 for amplifying the DAB L signal and the GPS signal is used, the diplexer serving to separate these two signals such that the GPS signal can be amplified again via the second amplifier stage 117 provided.

Finally, reference is also made to an embodiment, which is modified in relation to FIG. 18*a*, for example, with reference to FIGS. 22 and 23 in order to show that the connecting lines 29 can extend not only with multiple steps and/or in a meandering pattern, U-shaped, Z-shaped, etc., between the patch electrode 7 and the director 23, but, for example, also obliquely, i.e. with alignment components that do not extend perpendicularly between the planes of the director 23 and the patch electrode 7, as shown in FIG. 22 or, for example, even in a curve (FIG. 23). Common to all of these embodiments is that ultimately the connecting line has a greater length than the shortest and thus perpendicular distance between the patch electrode 7 and the director 23. Due to the configurations of the connecting line 29 that are longer in comparison to this distance, the desired adjustment and adaptation can be carried out. With reference to FIG. 23, it is shown that the connecting line 29 can also have any bow shape, it being possible for the respective connection points on the patch electrode 7 and the director 23 to be congruent or offset from each other in a perpendicular plan view of the antenna array and thus of the patch electrode or the director 23.

It can also be seen from all of the embodiments described that the patch electrode 7 with the patch electrode surface 7' and the attachment patch 23 with the attachment patch surface 23' are preferably galvanically or capacitively, and therefore electrically, connected to one another, such that in all of the embodiments referred to, however, the ground plane 9 and the patch electrode 7 are configured so as not to connect, neither a galvanic nor a capacitive connection therefore being provided here, since such a short circuit connection or capacitive connection would eliminate the advantages described.

The invention claimed is:

1. Antenna array configured as a left or right circularly polarized antenna array, the antenna array comprising:

a dielectric having a length (L), a width (B) and a height (H), the dielectric comprising an upper side, a patch electrode with a patch electrode surface is provided above the dielectric or on the upper side of the dielectric, the patch electrode having a circular resonance ($RF_Z$), the patch electrode being fed via a feeder, which passes through the dielectric and in the passing is guided to a feeding point which is galvanically or capacitively connected to the patch electrode, an electrically conductive attachment patch provided at a distance (D) above the patch electrode, the electrically conductive attachment patch having an attachment patch surface, the patch electrode and the attachment patch being arranged perpendicularly to a central axis (Z) passing through the antenna array, the electrically conductive attachment patch having a linear resonance frequency (FR), at least one electrical connecting line provided between the patch electrode and the attachment patch, the at least one electrical connecting line having a linear resonance frequency ($FR_L$), the at least one electrical connecting line between the patch electrode and the attachment patch having at least plural non-coaxial line sections oriented non-transversely to the central axis (Z), the plural non-transversely oriented line sections having a combined length that is the distance D or an integer multiple of the distance D, the at least one electrical connecting line including said plural line sections being configured to relocate the linear resonance frequency (FR) of the attachment patch toward the range of the circular resonance ($RF_Z$) of the patch electrode to shift the linear resonance into the circular resonance of the patch electrode and thereby pivot a main lobe direction of the antenna array in relation to the central axis (Z).

2. Patch antenna array according to claim 1, wherein the connecting line has at least one line portion, which extends perpendicularly to the central axis (Z) or parallel to the patch electrode or to the attachment patch.

3. Patch antenna array according to claim 1, wherein the length of the at least one connecting line is greater than the distance (D) between the patch electrode and the attachment patch.

4. Patch antenna array according to claim 1, wherein the at least one connecting line comprises at least three line sections, a first and a third of the at least three line sections and/or the connection points to the attachment patch and to the patch electrode not being positioned in alignment with one another in relation to the central axis (Z).

5. Patch antenna array according to claim 1, wherein the at least one connecting line comprises at least three line sections, the first and third of the at least three line sections and/or the connection points on the attachment patch and to the patch electrode being positioned in alignment with one another in relation to the central axis (Z).

6. Patch antenna array according to claim 1, wherein the connecting line consists of or comprises a block or cylinder, at least a portion of which is aligned obliquely to the central axis (Z) and is electrically conductive or at least coated with an electrically conductive surface.

7. Patch antenna array according to claim 1, wherein at least two connecting lines or at least four connecting lines are provided, via which a galvanic or capacitive connection is produced between the patch electrode and the attachment patch.

8. Patch antenna array according to claim 1, wherein the attachment patch consists of or comprises an electrically conductive metal sheet or an edged metal sheet having edge portions formed all round or in portions at the peripheral edge.

9. Patch antenna array according to claim 1, wherein parallel to the patch electrode and galvanically separated therefrom, a coupling surface is provided, which is galvanically connected to the attachment patch via the at least one connecting line.

10. Patch antenna array according to claim 1, wherein underneath the attachment patch and capacitively coupled to it, a coupling surface is provided, between which and the patch electrode a galvanic connection is produced via the at least one connecting line.

11. Patch antenna array according to claim 1, wherein on the opposite side of the patch electrode to the dielectric and capacitively coupled to said patch electrode, a coupling surface is provided, and in that on the side of the attachment patch facing the patch antenna a coupling surface coupled to the attachment patch is provided, and in that the two coupling surfaces are galvanically connected to one another via at least one electrical connecting line.

12. Patch antenna array according to claim 1, wherein the clearance between the patch electrode and the attachment patch comprises a dielectric, which consists of air at least in part or up to a partial height.

13. Patch antenna array according to claim 1, wherein the clearance between the patch electrode and the attachment patch comprises a solid dielectric at least in part or up to a partial height.

14. Patch antenna array according to claim 1, wherein the attachment patch and/or a dielectric located underneath it has a central opening passing through the attachment patch and/or the dielectric.

15. Patch antenna array according to claim 13, wherein the attachment patch is constructed on the upper side of the dielectric, which in turn is positioned on and/or glued to the patch electrode or a coupling surface extending parallel thereto.

16. Patch antenna array according to claim 13, wherein the dielectric has one or more connecting lines or a through-connection passing through it.

17. Patch antenna array according to claim 13, wherein the dielectric consists of a printed circuit board material.

18. Patch antenna array according to claim 1, wherein the block or cylinder is arranged in the central opening in the dielectric.

19. Patch antenna array according to claim 14, wherein the central opening passes through the thickness (D) of the attachment patch and/or the dielectric, the side walls of the central opening being coated with an electrically conductive layer of material producing a through-connection, via which the attachment patch and the patch electrode or a coupling surface coupled to it are electrically connected.

20. Patch antenna array according to claim 1, wherein the patch electrode and/or the attachment patch are provided with an obliquely extending chamfer at two corner regions opposite one another at 180°.

21. Patch antenna array according to claim 20, wherein the patch electrode and the attachment patch are chamfered and have the same alignment in terms of their opposite chamfers, such that the chamfers are located parallel to one another.

22. Patch antenna array of claim 1 further including a conductive ground plane disposed on an underside of the dielectric, wherein the ground plane is not electrically connected to the patch electrode.

23. Patch antenna array of claim 1 wherein the connecting line includes a feeder, and the position of the connecting line feeder on the attachment patch is configured to shift the linear resonance into the circular resonance.

24. Patch antenna array of claim 1 wherein the at least one connecting line including said plural line sections is configured to set a main beam direction at an incline relative to the patch electrode surface in a deviation from a perpendicular alignment.

25. Antenna array configured as a left or right circularly polarized antenna array, the antenna array comprising:

a dielectric having a length (L), a width (B) and a height (H) and having an upper side and an underside, a patch electrode with a patch electrode surface provided on or above the upper side of the dielectric, the patch electrode having a circular resonance ($RF_Z$), the patch electrode being fed via a feeder, which passes through the dielectric and in the passing is guided to a feeding point which is galvanically or capacitively connected to the patch electrode, an electrically conductive attachment patch provided at a distance (D) above the patch electrode, the patch electrode and the attachment patch being arranged perpendicularly to a central axis (Z) passing through the antenna array, the attachment patch having a linear resonance (FR); and means disposed between the patch electrode and the attachment patch for relocating the linear resonance (FR) of the attachment patch toward the range of the circular resonance ($RF_Z$) of the patch electrode to thereby shift said linear resonance into the circular resonance of the patch electrode, pivot a main lobe direction of the antenna array in relation to the central axis (Z) and set a main beam direction at an incline relative to the patch electrode surface in a deviation from a perpendicular alignment to said patch electrode, the means for relocating including at least one electrical connecting line provided between the patch electrode and the attachment patch, the at least one electrical connecting line having plural non-coaxial line sections oriented non-transversely to the central axis (Z), the plural non-transversely oriented line sections having a combined length that is the distance D or an integer multiple of said distance D.

* * * * *